US008092320B2

(12) United States Patent
Yamagishi et al.

(10) Patent No.: US 8,092,320 B2
(45) **Date of Patent: *Jan. 10, 2012**

(54) GOLF CLUB HEAD

(75) Inventors: Hisashi Yamagishi, Hanno (JP); Yasunori Imamoto, Saginuma (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/965,346

(22) Filed: Dec. 10, 2010

(65) Prior Publication Data

US 2011/0086725 A1 Apr. 14, 2011

Related U.S. Application Data

(60) Division of application No. 12/402,617, filed on Mar. 12, 2009, now Pat. No. 7,878,923, which is a continuation of application No. 11/780,778, filed on Jul. 20, 2007, now Pat. No. 7,695,377.

(30) Foreign Application Priority Data

Jul. 24, 2006 (JP) ..... 2006-200836

(51) Int. Cl.
*A63B 53/04* (2006.01)

(52) U.S. Cl. ..... 473/331

(58) Field of Classification Search ..... 473/324–350
See application file for complete search history.

(56) References Cited

U.S. PATENT DOCUMENTS

| | | | |
|---|---|---|---|
| 1,337,958 | A | 4/1920 | Reach |
| 1,965,954 | A | 4/1930 | Davis |
| 4,693,478 | A | 9/1987 | Long |
| 5,437,088 | A | 8/1995 | Igarashi |
| 5,755,626 | A | 5/1998 | Shira |
| 6,402,637 | B1 | 6/2002 | Sasamoto et al. |
| 6,517,445 | B1 | 2/2003 | O'Neill |
| 6,530,998 | B1 | 3/2003 | Oofune |
| 6,566,796 | B2 | 5/2003 | Kodama et al. |
| 6,981,923 | B2 | 1/2006 | Chappell |
| 7,090,591 | B2 | 8/2006 | Sano |
| 7,115,050 | B2 | 10/2006 | Andre et al. |
| 7,156,751 | B2 | 1/2007 | Wahl et al. |
| 7,166,039 | B2 | 1/2007 | Hettinger et al. |
| 7,273,422 | B2 | 9/2007 | Vokey et al. |
| 7,429,219 | B2 | 9/2008 | Huang |
| 7,452,283 | B2 | 11/2008 | Hettinger et al. |
| 7,491,136 | B2 | 2/2009 | Deng et al. |

(Continued)

FOREIGN PATENT DOCUMENTS

| | | | |
|---|---|---|---|
| JP | 4-336083 | A | 11/1992 |

(Continued)

OTHER PUBLICATIONS

Office Action issued on Jun. 21, 2011 in Japanese Patent Application No. 2006-200836.

*Primary Examiner* — Alvin Hunter
(74) *Attorney, Agent, or Firm* — Sughrue Mion, PLLC

(57) ABSTRACT

The present invention provides a golf club head that can hit a ball with a sufficiently large amount of backspin. The golf club head according to the present invention is an iron type golf club head made of a metal and including a flat face. A plurality of traces are formed by milling on the face. The pitch of the traces is between 0.1 mm and 1 mm.

5 Claims, 4 Drawing Sheets

U.S. PATENT DOCUMENTS

| | | | |
|---|---|---|---|
| 7,594,863 | B2 | 9/2009 | Ban |
| 7,674,188 | B2 | 3/2010 | Ban |
| 7,677,990 | B2 | 3/2010 | Ban |
| 7,695,377 | B2 | 4/2010 | Yamagishi et al. |
| 7,749,105 | B2 | 7/2010 | Zielke et al. |
| 7,758,449 | B2 | 7/2010 | Gilbert et al. |
| 7,857,712 | B2 | 12/2010 | Nishitani et al. |
| 7,878,923 | B2 | 2/2011 | Yamagishi et al. |
| 7,918,747 | B2 | 4/2011 | Johnson et al. |
| 2002/0016217 | A1 | 2/2002 | Takeda et al. |
| 2002/0132683 | A1 | 9/2002 | Buchanan |
| 2003/0008724 | A1 | 1/2003 | Griffin |
| 2003/0126734 | A1 | 7/2003 | Takeda |
| 2004/0142764 | A1 | 7/2004 | Sano |
| 2005/0245329 | A1 | 11/2005 | Nishitani et al. |
| 2005/0250594 | A1 | 11/2005 | Nishitani et al. |

FOREIGN PATENT DOCUMENTS

| | | | |
|---|---|---|---|
| JP | 6-71002 | A | 3/1994 |
| JP | 08-000777 | A | 1/1996 |
| JP | 08-206260 | A | 8/1996 |
| JP | H08-206260 | A | 8/1996 |
| JP | 08-229169 | A | 9/1996 |
| JP | 08-257182 | A | 10/1996 |
| JP | 09-070457 | A | 3/1997 |
| JP | H09-056855 | A | 3/1997 |
| JP | 09-099120 | A | 4/1997 |
| JP | 09-253250 | A | 9/1997 |
| JP | 10-015116 | A | 1/1998 |
| JP | H10-305118 | A | 11/1998 |
| JP | 11-137746 | A | 5/1999 |
| JP | 2000-296191 | A | 10/2000 |
| JP | 2002-000779 | A | 1/2002 |
| JP | 2002-28266 | A | 1/2002 |
| JP | 2002-315857 | A | 10/2002 |
| JP | 2005-312619 | A | 11/2005 |
| JP | 2005-319019 | A | 11/2005 |
| JP | 2008-23178 | A | 2/2008 |
| JP | 2008-132169 | A | 6/2008 |
| JP | 2008-136619 | A | 6/2008 |
| JP | 2008-136833 | A | 6/2008 |
| TW | 509585 | B | 11/2002 |
| WO | 2004/101079 | A1 | 11/2004 |

GOLF CLUB HEAD

This is a divisional of application Ser. No. 12/402,617, filed Mar. 12, 2009 now U.S. Pat. No. 7,878,923, which is a continuation of application Ser. No. 11/780,778, filed Jul. 20, 2007 now U.S. Pat. No. 7,695,377. The entire disclosure of the prior applications, application Ser. Nos. 12/402,617 and 11/780,778, are hereby incorporated by reference.

BACKGROUND OF THE INVENTION

1. Field of the Invention

The present invention relates to an iron type golf club head and, more particularly, to a golf club head in which traces are formed on the face by milling.

2. Description of the Related Art

U.S. Pat. No. 5,437,088 describes a golf club head in which traces (cutting marks) are formed on the face by milling (cutting by a milling machine). According to this patent, after forming corrugations (scoring lines) on the face, the face undergoes milling to sharpen the edges of the corrugations. The sharp edges and traces formed by milling increase the spin of the ball. FIG. 1*a* of this patent shows that the pitch of the corrugations is almost equal to that of the traces. As the traces, both downwardly convex arcuate traces and upwardly convex arcuate traces are formed. With this machining method, however, the depths and widths of the grooves may undesirably become nonuniform depending on the inclination of the face.

When forming the traces with the same pitch as the pitch (usually 2.8 mm to 3.6 mm) of the corrugations, as in U.S. Pat. No. 5,437,088, the amount of spin does not increase very much.

SUMMARY OF THE INVENTION

It is an object of the present invention to provide a golf club head that can hit a ball with a sufficiently large amount of backspin.

According to the present invention, there is provided an iron type golf club head made of metal and including a flat face, comprising: a plurality of traces formed by milling on the face, wherein the pitch of the traces is between 0.1 mm and 1 mm.

The golf club head according to the present invention comprises the plurality of traces at a small pitch. The traces themselves enhance the function of increasing the friction between the face and ball to increase the amount of backspin (to be merely referred to as amount of spin hereinafter) of the ball.

Further features of the present invention will become apparent from the following description of exemplary embodiments (with reference to the attached drawings).

DESCRIPTION OF THE EMBODIMENTS

The embodiments of the present invention will be described hereinafter with reference to the accompanying drawings.

Figure 1:
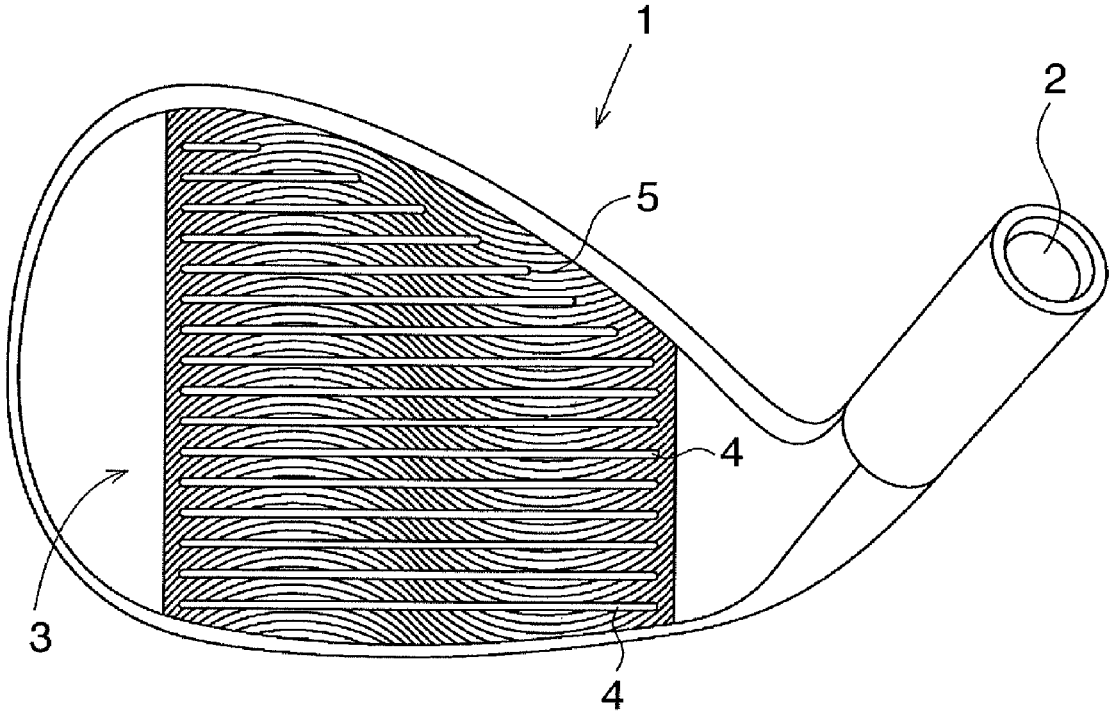
FIG. 1 is a front view of a golf club head according to an embodiment of the present invention.
Figure 2:
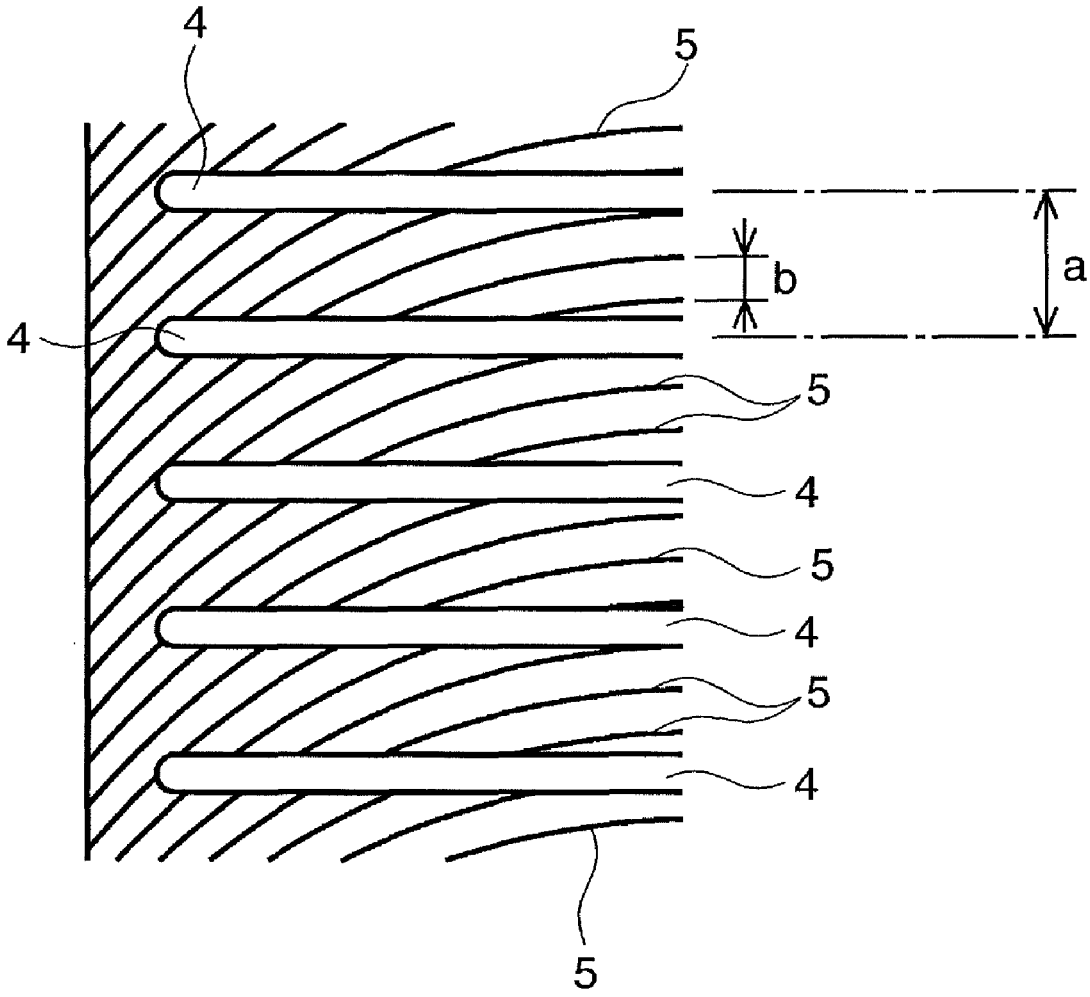
FIG. 2 is an enlarged view of part of the golf club head in FIG. 1.
Figure 3:
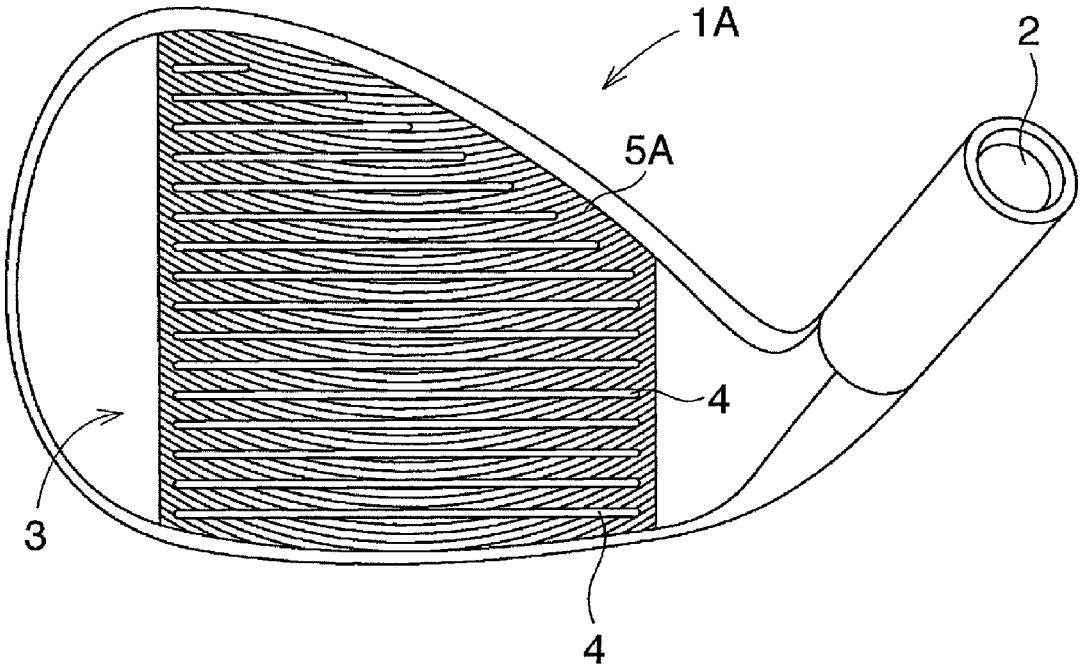
FIG. 3 is a front view of a golf club head according to another embodiment of the present invention.
Figure 4:
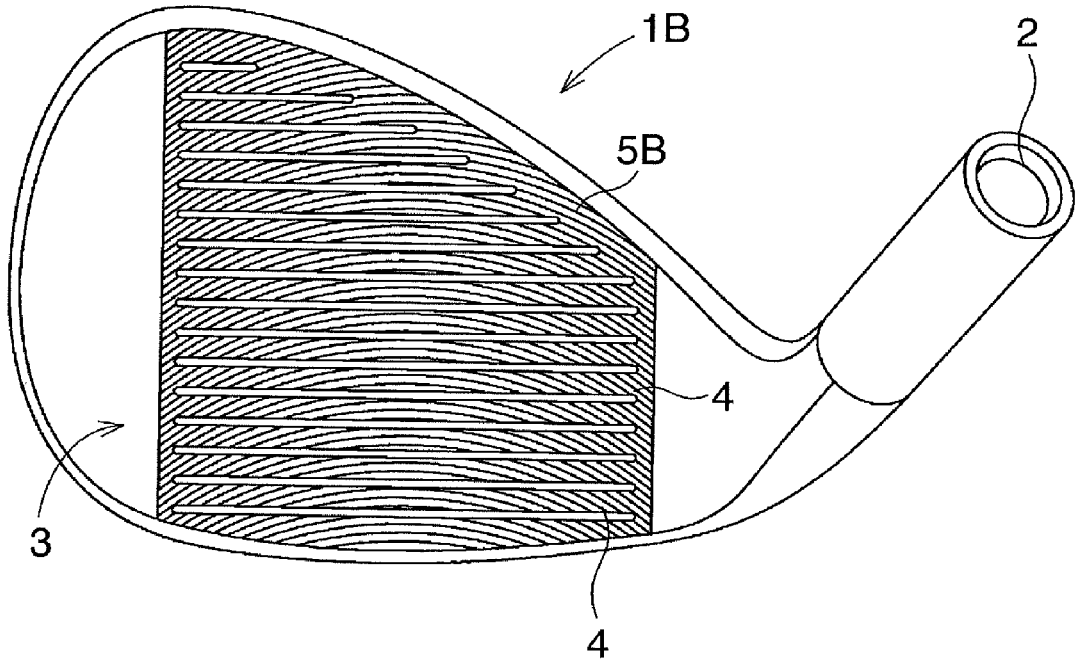
FIG. 4 is a front view of a golf club head according to still another embodiment of the present invention.

FIGS. 1, 3, and 4 are respectively front views of iron golf club heads 1, 1A, and 1B according to the embodiments of the present invention, and FIG. 2 is an enlarged view of part of the face of the golf club head 1 in FIG. 1. FIGS. 1, 3, and 4 are front views to oppose the faces and each show the golf club head in a soled state from the front in an obliquely upward direction.

Each of the golf club heads 1, 1A, and 1B has a hosel portion 2 on its heel side. A shaft is inserted in the hosel portion 2 and fixed with an adhesive to constitute a golf club.

A face 3 of each of the golf club heads 1, 1A, and 1B comprises a plurality of corrugations 4 and a plurality of traces 5, 5A, or 5B formed by milling. The corrugations 4 extend in the toe-and-heel direction and are parallel to each other. A pitch a (the distance between two adjacent corrugations 4)of the corrugations 4 is between 2.8 mm and 3.6 mm. The corrugations 4 may have any sectional shape in the direction of depth, for example, a U shape, semicircular shape, V shape, square, or polygonal shape.

The traces 5 form an S shape, and both the traces 5A and 5B form arcuate curves.

The traces 5A in FIG. 3 form downwardly convex arcs. The lowermost portion of each arc is located at the center (the center in the toe-and-heel direction) of the face. When the traces 5A form arcs in this manner, if arranging the tops of the arcs near the center of the face 3, the traces 5A can give the ball spin in the straight. The traces 5A are almost parallel to each other. More specifically, the distances among the traces 5A are almost the same in the longitudinal direction of the traces 5A. Being almost the same signifies that the error falls within a range of ±5%. If the traces 5A do not cross each other but extend parallel to each other in this manner, the friction characteristics between the ball and face 3 in the entire face 3 become uniform.

The traces 5B in FIG. 4 form upwardly convex arcs. The uppermost portion of each arc is located at the center (the center in the toe-and-heel direction) of the face. When the traces 5B form arcs in this manner, if arranging the tops of the arcs near the center of the face 3, the traces 5B can give the ball spin in the straight direction, The traces 5B are almost parallel to each other (more specifically, the distances among the traces 5B are almost the same in the longitudinal direction of the traces 5B). If the traces 5B do not cross each other but extend parallel to each other in this manner, the frictional characteristics between the ball and face 3 in the entire face 3 become uniform.

In the embodiments shown in FIGS. 3 and 4, the traces 5A and 5B preferably have radii of curvature of 70 mm to 150 mm, more preferably about 80 mm to 120 mm.

In the golf club head 1 of FIGS. 1 and 2, the traces 5 include upwardly convex arcs with a radius of curvature of about 40 mm to 80 mm on the toe side with respect to the center of the face 3, and downwardly convex arcs with a radius of curvature of about 40 mm to 80 mm on the heel side, thus forming an S shape as a whole. As shown in FIG. 1, the traces 5 are consecutive from the toe side to the heel side. The uppermost portions of the convexes and the lowermost portions of the concaves are preferably located within a range of 20 mm to 30 mm from the center. In FIGS. 1 and 2 as well, the distance between the adjacent traces 5 is almost the same in the longitudinal direction of the traces 5. If the traces 5 do not cross each other but extend parallel to each other in this manner, the frictional characteristics between the ball and face 3 in the entire face 3 become uniform.

In FIG. 1, the traces 5 are upwardly convex on the toe side and downwardly convex on the heel side. Conversely, the traces 5 may be downwardly convex on the toe side and upwardly convex on the heel side.

A pitch b (the distance between the adjacent two traces) of the traces 5, 5A, or 5B is between 0.1 mm and 1 mm. The pitch b is preferably between 0.1 mm and 0.5 mm.

On the surface that has undergone milling, the traces extend in the form of sharp ridge-like convex streaks, and the portions among the traces extend in the form of arcuate concave streaks. The depths of the concave streaks (the differences in height between the vertexes of the convex streaks and the deepest portions of the concave streaks) are preferably between 15 μm and 30 μm.

In the golf club heads 1, 1A, and 1B formed in this manner, as the traces 5, 5A, and 5B are dense, the amount of spin increases.

In particular, in the golf club head 1 in FIGS. 1 and 2, as the arcs form an S shape, the traces 5 extend obliquely near the center of the face. This imparts a slight frictional force having a component in a direction perpendicular to the traces 5 to the spin of the ball which is hit near the center of the faces. Therefore, the golf club head 1 in FIGS. 1 and 2 imparts very slight draw spin to the ball.

In contrast to the golf club head 1 in FIG. 1, when forming S-shaped traces including downward convexes on the toe side and upward convexes on the heel side, the golf club head 1 imparts very slight fade spin.

In the golf club head 1, the corrugations 4 may be formed on the face 3, and thereafter the face 3 may undergo milling to form the arcs 5, 5A, or 5B. Preferably, the face 3 undergoes milling first to form the arcs 5, 5A, 5B, and thereafter the corrugations 4 are formed by cutting.

In this manner, in the manufacture of the golf club head, when forming the corrugations 4 after milling, the edges of the corrugations 4 become sharp to increase the amount of spin.

Preferably, no plating film is formed on the face 3 but an oxide film is formed, and the surface hardness is set to 300 Hv, preferably 250 Hv to 180 Hv. The plating film rounds the edges of the corrugations 4 and decreases steps in the traces. Surface treatment can harden the surface, thus preventing wear.

Preferably, the base material of the face 3 is carbon steel containing 0.1 wt % to 0.5 wt % of carbon, and the oxide film is a $Fe_3O_4$ film whose thickness is about 1 μm to 5 μm.

Such a film can prevent light reflection and glare. The low surface hardness as described above can provide a soft hitting feel, particularly a good hitting feel in the approach shot.

As the method of forming the $Fe_3O_4$ film, a method called a blackening treatment is preferable, in which the main body of the head is dipped in a 110° C. to 150° C., preferably 120° C. to 140° C. solution of caustic soda, sodium nitrate, sodium nitrite, or the like, and is picked from the solution after the lapse of an appropriate time by checking the degree of discoloration. The dipping time may be about 5 min to 30 min depending on the concentration of the solution. Thus, an oxide film can be formed very easily.

After forming the oxide film, preferably, a corrosion inhibitor oil may be applied to the golf club head to prevent corrosion. Particularly, if putting an oxidized head in a vessel such as a pot containing a corrosion inhibitor oil and boiling the head, the corrosion inhibiting effect can be enhanced.

In each of the golf club heads 1, 1A, and 1B, the entire golf club head may be formed of one material by forging or casting monolithically. Alternatively, the face 3 may be formed of a face plate. The head main body portion other than the face plate may be formed of a material different from that of the face plate. The face plate may be fixed to the head main body by caulking, screw fitting, shrink fitting, expansion fit, welding (e.g., laser welding or electron beam welding), or the like. Forming the face plate separately of the main body of the head can facilitate machining of the face 3. Also, the degrees of freedom in selecting the material of the face 3 increase.

The main body of the head is preferably made of steel, particularly stainless steel. The face 3 is preferably made of soft iron (carbon steel 15C to S35C), stainless steel, pure titanium, a titanium alloy, a copper alloy such as a beryllium-copper alloy, or the like.

The suitable manufacturing conditions and the like for the golf club heads 1, 1A, and 1B will be described in detail.

First, a round bar made of carbon steel S15C to S35C (a steel stock containing 0.15% to 0.35% of carbon) is cut into a necessary size and forged. For forging, the steel stock (carbon steel) heated to 1,000° C. or more is set in two, upper and lower, molds and forged. This forging is repeated several times to form the shape of an iron golf club head. After that, burrs are removed, and an oxide film is removed using a grinder such as a belt sander. Rough finish polishing and semi-finish polishing are performed. During the polishing, the face 3 is machined flat using the belt sander.

Subsequently, the steel stock is fixed in a lower mold that conforms to the shape of the iron golf club head, and undergoes milling by an NC (numerical controlled) milling machine. At this time, the NC milling machine performs fine milling once for polishing. Then, the NC milling machine forms a circular cutting pattern using a slightly rough blade. The suitable diameter of the blade is about 60 mm to 180 mm. If the diameter is small, the blade must reciprocate many times to form the cutting pattern on the face 3, requiring a long period of time, Milling forms the highly accurate face 3. The NC milling machine or an engraving machine forms the corrugations 4 with reference to the face 3. The diameter of the blade used for forming the corrugations 4 is approximately 0.7 mm (0.0275 inch) (inclusive) to 0.9 mm (0.035 inch) (exclusive). Thus, the blade forms the grooves with accurate depths and widths.

When forming the golf club head with this process, the edges of the corrugations 4 are not rounded at the intersections with the face 3, so that a golf club head that can easily hit the ball with backspin can be obtained. The amount of backspin can also be increased by leaving the traces formed by milling on the face 3.

Casting may be performed in place of forging. In the case of casting, a golf club head is manufactured with almost the same process. In casting, stainless steel is employed.

If the golf club head is formed of stainless steel by casting, it is also fixed in a lower mold that conforms to the shape of the iron golf club head, and undergoes milling by the NC milling machine. Preferably, a circular cutting pattern which is obtained at this time may be left, and the corrugations 4 (slightly narrow and shallow) which are formed in advance are utilized to form the corrugations 4 by the NC milling machine, as described above. Generally, stainless steel (17-4PH or the like) is harder than carbon steel (soft iron) used to form the iron golf club head. If forming preliminary grooves in advance to facilitate machining, the service life of the milling blade can be extended.

Then, the following treatment may be performed so that the effect of increasing the amount of spin lasts sufficiently long or corrosion is prevented. For example, an oxide film is formed as described above on the iron surface.

When the face 3 is made of titanium, stainless steel, or the like, the oxide film treatment can also be performed positively. If the face 3 is made of titanium, heat treatment at about 600° C. can form a $TiO_2$ film on the face 3. If the face 3 is made of stainless steel or the like, for example, a method of dipping the golf club head in a nitrate-based oxidizing agent can be employed. If treating the golf club head under high temperature, the plate may deform. Therefore, the oxidization treatment of dipping the golf club head in an oxidizing solution is preferable.

The surface of the face 3 may be hardened to prevent wear of the face 3, so that the effect described above lasts. As the hardening method, carburizing treatment, nitriding treatment, Tufftride treatment, or the like is preferable. Any one of these treatments hardens the surface itself, in the same manner as the oxidizing treatment described above. Accordingly, unlike in plating, no extra layer is formed on the face 3. Therefore, the traces 5, 5A, or 5B and the edges formed by the corrugations 4 and face 3 become sharp to enhance the backspin effect. As the carburizing treatment is generally performed at 800° C. to 1,000° C., the nitriding treatment with heat of, approximately 500° C. is preferable. The Tufftride (salt-bath soft nitriding) treatment is also preferable as it performs treatment with heat of approximately 600° C. Ion nitriding treatment or soft nitriding treatment as the nitriding treatment is preferable as it takes a shorter period of time than gas nitriding treatment. Ion nitriding treatment is particularly preferable as it can be performed at 500° C. or lower.

EXAMPLES

Example 1

A soft iron material S20C was forged to manufacture a golf club head element with a loft angle of 58°. The element was milled to form 0.2-mm pitch S-shaped traces. After that, the engraving machine formed corrugations on the element. The corrugations had a groove width of 0.85 mm, groove depth of 0.45 mm, and pitch of 3.6 mm. Subsequently, blackening treatment was performed to form a 178-Hv hardness $Fe_3O_4$ film. After that, a corrosion inhibitor oil was applied to the element. No strain was observed on the face, and the milling marks were left clearly.

A shaft was attached to the golf club head to form a golf club (club length: 35 inches). This golf club underwent actual hitting evaluation assuming a case of aiming at a pin about 40 yards ahead. The results are as follows. The evaluation was performed by measuring the amount of backspin for 10 hits.

As Comparative Example 1, a material S20C was forged, and the obtained element was polished by a belt sander. Corrugations were engraved on the element using a roll press. The element underwent nickel plating, chrome plating, and sandblasting to fabricate a golf club head. This golf club head was evaluated in the same manner.

As Comparative Example 2, corrugations were engraved again on the head of Comparative Example 1 using an engraving machine to fabricate a golf club head. This golf club head was evaluated in the same manner. Table 1 shows the results.

TABLE 1

| Club to Evaluate | Comparative Example 1 | Comparative Example 2 | Example 1 |
|---|---|---|---|
| Scoring Line | Roll Press | Engraving | Engraving |
| Milling | Not Done | Not Done | Done |
| Milling Pitch (mm) | — | — | 0.2 |
| 1st Trial Hitting | 6000 | 5990 | 6430 |
| 2nd Trial Hitting | 6250 | 6130 | 6550 |
| 3rd Trial Hitting | 6300 | 5800 | 6390 |
| 4th Trial Hitting | 5860 | 5950 | 6410 |
| 5th Trial Hitting | 5900 | 6030 | 6350 |
| 6th Trial Hitting | 5780 | 6100 | 6390 |
| 7th Trial hitting | 5990 | 5970 | 6580 |
| 8th Trial Hitting | 6010 | 5980 | 6570 |
| 9th Trial Hitting | 5870 | 6010 | 6400 |
| 10th Trial Hitting | 6010 | 6000 | 6440 |
| Average | 5997 | 5996 | 6451 |
| Standard Deviation | 166 | 89 | 84 |

As shown in Table 1, in Comparative Example 1, backspins were few, and variations in the amount of backspin were large. In Comparative Example 2, although backspins were few, the amount of backspin was stable and variations were small. In contrast to this, in Example 1, the amount of backspin increased, and variations in the amount of backspin were small and stable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-200836, filed Jul. 24, 2006 which is hereby incorporated by reference herein in its entirety.

What is claimed is:

1. An iron type golf club head made of metal and including a flat face, comprising:

a plurality of traces formed by milling on said face, wherein the pitch of said traces is between 0.1 mm and 1 mm, no plating film is formed on said face, and said face undergoes at least nitriding treatment, wherein said traces do not cross each other but extend substantially parallel to each other.

2. An iron type golf club head made of metal and including a flat face, comprising:

a plurality of traces formed by milling on said face, wherein the pitch of said traces is between 0.1 mm and 1 mm, no plating film is formed on said face, and said face undergoes at least nitriding treatment, wherein said nitriding treatment is Ion nitriding treatment or soft nitriding treatment.

3. The golf club head according to claim 1, wherein said traces form downwardly convex arcs.

4. The golf club head according to claim 1, wherein said traces form upwardly convex arcs.

5. The golf club head according to claim 1, wherein said traces form S-shaped arcs.

* * * * *